US005992571A

United States Patent [19]

Lee

[11] Patent Number: 5,992,571

[45] Date of Patent: Nov. 30, 1999

[54] MAST ASSEMBLY FOR FORKLIFT TRUCKS

[75] Inventor: Seung Ho Lee, Seoul, Rep. of Korea

[73] Assignee: Daewoo Heavy Industries Ltd., Incheon, Rep. of Korea

[21] Appl. No.: 08/774,818

[22] Filed: Dec. 27, 1996

[30] Foreign Application Priority Data

Dec. 30, 1995 [KR] Rep. of Korea ..... 95-54713

[51] Int. Cl.[6] ..... B66F 9/08

[52] U.S. Cl. ..... 187/228; 187/229

[58] Field of Search ..... 187/228, 229, 187/222, 226; 414/914

[56] References Cited

U.S. PATENT DOCUMENTS

| | | | |
|---|---|---|---|
| 2,724,520 | 11/1955 | Overbeck | 187/228 |
| 2,932,419 | 4/1960 | Harris | 187/228 |
| 3,289,869 | 12/1966 | Hoyt | 187/228 |
| 3,709,393 | 1/1973 | McGehee | 187/226 |
| 3,894,616 | 7/1975 | Kawanishi et al. | 187/228 |
| 3,968,859 | 7/1976 | Ehrhardt | 187/228 |
| 4,392,773 | 7/1983 | Johannson . | |
| 4,703,834 | 11/1987 | Knappe | 187/228 |
| 4,765,441 | 8/1988 | David et al. | 187/226 |
| 4,896,748 | 1/1990 | Mikkelsen et al. . | |
| 5,326,217 | 7/1994 | Simpson et al. | 187/226 |

FOREIGN PATENT DOCUMENTS

| | | | |
|---|---|---|---|
| 7-187594 | 7/1995 | Japan | 187/228 |

*Primary Examiner*—Christopher P. Ellis
*Assistant Examiner*—Thuy V. Tran
*Attorney, Agent, or Firm*—Lowe Hauptman Gopstein Gilman & Berner

[57] ABSTRACT

A mast assembly for forklift trucks improves the vehicle operator's front visibility by way of widening the window provided at the center thereof. The mast assembly includes a first hose sheave rotatably attached to the top of an intermediate mast and a second hose sheave rotatably secured to the intermediate mast at a location immediately below the first hose sheave and having a diameter smaller than that of the first hose sheave. First and second fluid hoses wound respectively around the first and second hose sheaves, each of the fluid hoses having a rear end anchored to the outer mast and a front end affixed to the carriage assembly which can slide along an inner mast. The carriage assembly is capable of holding first and second attachment actuators in fluid communication with the first and second fluid hoses.

5 Claims, 3 Drawing Sheets

MAST ASSEMBLY FOR FORKLIFT TRUCKS

FIELD OF THE INVENTION

The present invention relates generally to a reach type forklift truck and, more specifically, to a mast assembly for forklift trucks whose hose sheaves and fluid hoses for feeding pressurized fluid to attachment actuators are arranged in such a manner as to maximize the operator's front vision.

BACKGROUND OF THE INVENTION

Extensive use has been made of forklift trucks to lift up such objects as loads, cargos, freights and the like for the purpose of their shipment and transportation from one place to another. Conventional forklift trucks customarily carry a vertically oriented mast assembly to which a carriage assembly is mounted for elevational movement therealong to raise the load up to a desired elevation. The carriage assembly is provided with a pair of spaced apart, generally parallel forks that overhang from the carriage assembly so as to take up the weight of the objects. The up/down movement of the carriage assembly may be redered effective by the combination of a lift jack and a lift chain associated therewith. Side shift cylinders may also be employed to have the carriage assembly move laterally, if appropriate.

U.S. Pat. No. 4,392,773 dated Jul. 12, 1983 to Johannson teaches a carriage assembly with shiftable forks so designed that all vertical forces are taken up by a lower bar to render the upper portion of the carriage assembly relatively light and small, thus allowing clear forward and downward vision for the vehicle operator. A primary feature of the '773 patent is that substantially only the horizontal forces are transferred to an upper bar of a side shifter, with the vertical forces to a lower bar of the side shifter.

U.S. Pat. No. 4,896,748 dated Jan. 30, 1990 to Mikkelsen et al. discloses a full free lift mast assembly that can significantly reduce bending of carriage lift jacks, fluid leakage, missequencing and like problems. The full free lift mast assembly has a first pair of spaced apart uprights, a second pair of spaced apart uprights mounted on the first pair of uprights and elevationally movable therealong and a carriage mounted on the second pair of uprights. A first mast lift jack is connected between the first and second pairs of spaced apart uprights. A connecting arrangement serves to couple cylinders of first and second carriage lift jacks and maintains them parallel in a preselected overlapping relationship with each other.

In addition to the mast assemblies as referred to above, use is made nowadays of a three stage mast assembly which has the ability to lift objects up to a further elevated position and which carries a number of attachment actuators to operate attachments optionally built to the mast assembly for special tasks. The typical three stage mast assembly includes an outer mast attached to the front end of a vehicle body, an intermediate mast elevationally movably mounted to the outer mast and an inner mast mounted to the intermediate mast for elevational movement therealong. Each of the outer, intermediate and inner masts is provided with a pair of spaced-appart parallel uprights and a so-called "window" is provided between the uprights of the inner mast so that the operator may have a forward look therethrough. Elevationally slidably mounted to the inner mast is a carriage assembly which has a pair of forks for supporting objects to be lifted or moved.

First and second chain sheaves are attached to the top inboard surface of the uprights of the intermediate mast to support first and second chains therearound, while first and second hose sheaves are disposed at the inboard side of the first and the second chain sheaves to support first and second fluid hoses therearound. The first and second chains suspend from the chain sheaves and are anchored at their rear ends to the outer mast and at their front ends to the bottom of the inner mast. Similarly, the first and second fluid hoses suspend from the hose sheaves and anchored at their rear ends to the outer mast and at their front ends to the carriage assembly.

Since the hose sheaves and the fluid hoses lie within the window defined by the uprights of the inner mast, the size of the window would be reduced significantly, narrowing the front vision of the operator to a great extent. The operator's vision will be further narrowed in such an operative condition wherein the carriage assembly alone is moved upwards into the upper region of the window with the intermediate and inner mast kept retracted. It would goes without saying that the operator shall have difficulty in operating the forklift truck in the reduced window size and the narrowed front vision.

SUMMARY OF THE INVENTION

Accordingly, it is an object of the invention to provide a mast assembly for forklift trucks that can increase the size of window provided at the center thereof and thus improve the operator's front visibility, while enjoying simplified structure.

With this object in view, the present invention provides a mast assembly including a first hose sheave rotatably attached to the top of an intermediate mast and a second hose sheave rotatably secured to the intermediate mast at a location immediately below the first hose sheave and having a diameter smaller than that of the first hose sheave. First and second fluid hoses are wound respectively around the first and second hose sheaves, each of the fluid hoses having a rear end affixed to a carriage assembly which can slide along an inner mast. The carriage assembly is capable of holding first and second attachment actuators in fluid communication with the first and second fluid hoses.

BRIEF DESCRIPTION OF THE DRAWINGS

The above and other objects, features, advantages of the invention will become apparent from a review of the following detailed description of the preferred embodiment taken in conjunction with the accompanying drawings, in which.

DETAILED DESCRIPTION OF THE PREFERRED EMBODIMENT

Figure 1:
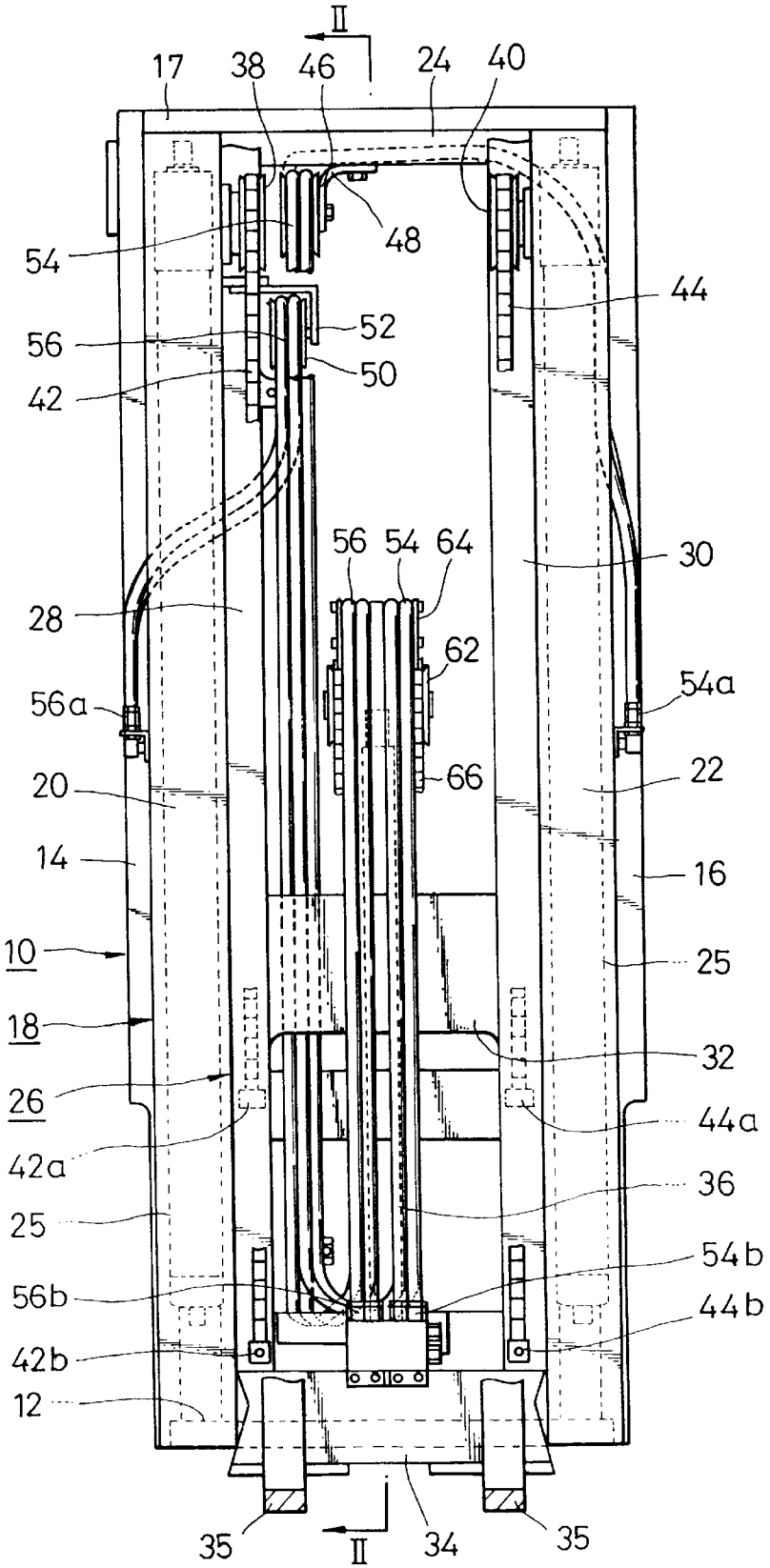
FIG. 1 is a front elevational view showing a mast assembly for forklift trucks in accordance with the invention.
Figure 2:
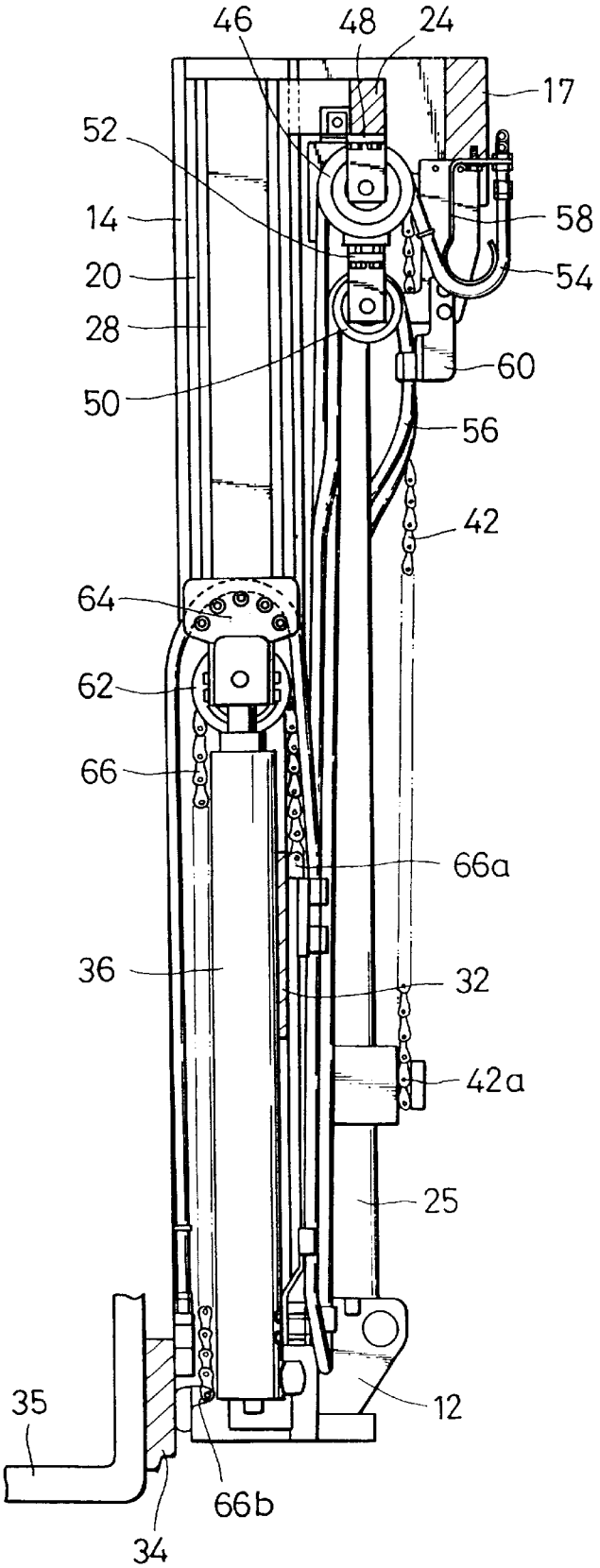
FIG. 2 is a side sectional view taken along line II—II in FIG. 1, with certain portions of the mast assembly cut away for simplification.

Referring initially to FIGS. 1 and 2, there is shown a mast assembly of the invention that may be attached to the front end of a forklift truck to lift objects up to an elevated position. The mast assembly is provided with an outer mast 10 which consists of a base frame 12, first and second uprights 14, 16 extending upwards from the base frame 12 in a parallel, spaced-apart relationship with each other, and a cross member 17 interconnecting the top ends of the first and second uprights 14, 16. Elevationally movably fitted to the outer mast 10 is an intermediate mast 18 which has first and second uprights 20, 22 engaging respectively with the uprights 14, 16 of the outer mast 10 and a cross member 24 interconnecting the top ends of the first and second uprights 20, 22. The intermediate mast 18 may be moved up and down along the outer mast 10 by lift cylinders 25 whose lower ends are pivoted to the base frame 12 of the outer mast 10, with the upper ends pivoted to the respective top end of the uprights 20, 22 of the intermediate mast 18.

Elevationally slidably fitted to the intermediate mast 18 is an inner mast 26 that consists of first and second uprights 28, 30 engaging respectively with the uprights 20, 22 of the intermediate mast 18 and a cross member 32 interconnecting the top ends of the first and second uprights 28, 30. A carriage assembly 34 with a pair of object carrying forks 35 is provided in front of the inner mast 26 for sliding movement along the latter by a carriage cylinder 36 built to the inner mast 26. Although not shown in the drawings, the carriage assembly 34 may be optionally equipped with first and second attachment actuators that can perform other task than lifting objects.

In the meantime, first and second chain sheaves 38, 40 are rotatably attached to the top inboard sides of the first and second uprights 20, 22 of the intermediate mast 18. Wound around or trained over the first and second chain sheaves 38, 40 are first and second lift chains 42, 44 each of which has a rear end 42*a* or 44*a* anchored to the uprights 14, 16 of the outer mast 10 and a front end 42*b* or 44*b* fixedly secured to the bottom of the uprights 28, 30 of the inner mast 26. Positioned alongside the first chain sheave 38 is a first hose sheave 46 which is rotatably attached to the cross member 24 of the intermediate mast 18 by virtue of a first mounting bracket 48. A second hose sheave 50 is disposed just below the first hose sheave 46 and is rotatably attached to the first upright 20 of the intermediate mast 18 by means of a second mounting bracket 52.

Figure 3:
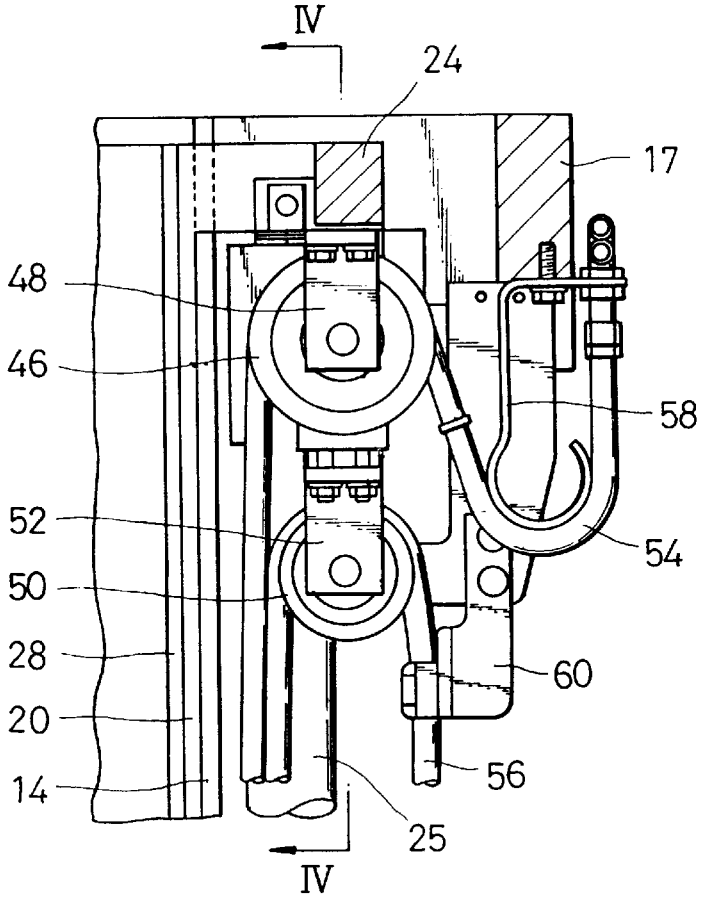
FIG. 3 is an enlarged sectional view best showing the top section of the mast assembly.
Figure 4:
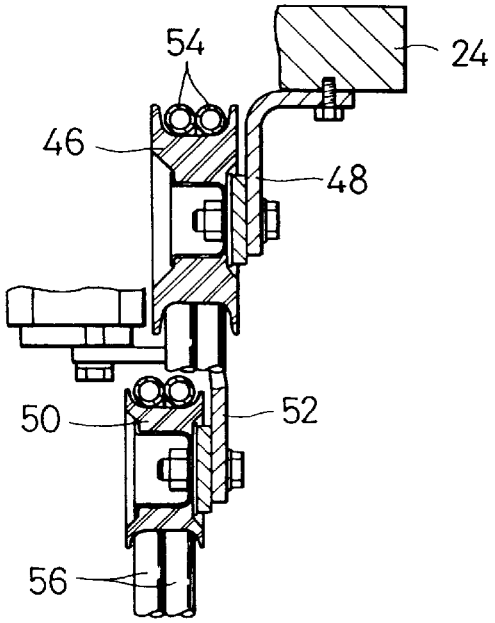
FIG. 4 is a sectional view taken along line IV—IV in FIG. 3, illustrating first and second hose sheaves disposed one above the other.

As clearly shown in FIGS. 3 and 4, the second hose sheave 50 has a smaller diameter than the first hose sheave 46 and is substantially coplanar with the first hose sheave 46. Unlike the illustrated embodiment, the first and second hose sheaves 46, 50 may lie on exactly the same plane, which would still fall within the scope of the invention.

Referring again to FIGS. 1 and 2, a first pair of fluid hoses 54 are wound around the first hose sheave 46 and remain anchored at their rear ends 54*a* to the second upright 16 of the outer mast 10 and at their front ends 54*b* to the carriage assembly 34. Likewise, a second pair of fluid hoses 56 are wound around the second hose sheave 50 and remain fixedly secured at their rear ends 56*a* to the first upright 14 of the outer mast 10 and at their front ends 56*b* to the carriage assembly 34. While not illustrated in the drawings, the rear ends 54*a*, 56*a* of the first and second pairs of fluid hoses 54, 56 would be connected to a fluid pump via a flow control valve and the front ends 54*b*, 56*b* thereof would come into fluid communication with first and second attachment actuators optionally mounted to the carriage assembly 34.

As will be seen in FIGS. 2 and 3, the first pair of fluid hoses 54 runs upwards from the rear ends 54*a* and are retained to the cross member 17 of the outer mast 10 by means of a first hose guide bracket 58 which serves to direct the first pair of fluid hoses 54 toward the first hose sheave 46. In the similar manner, the second pair of fluid hoses 54 extends upwards from the rear ends 56*a* and are retained to the cross member 17 of the outer mast 10 by means of a second hose guide bracket 60 which serves to direct the second pair of fluid hoses 54 toward the second hose sheave 50.

A third chain sheave 62 and a roller guide 64 are built to the top end of the carriage cylinder 36 one above the other. Wound around the third chain sheave 62 is a third lift chain 66 which has a rear end 66*a* fixedly secured to the cross member 32 of the inner mast 26 and a front end 66*b* anchored to the carriage assembly 34. The first and second pairs of fluid hoses 54, 56 extending downwards and then upwards from the first and second hose sheaves 46, 50 are wound around the roller guide 64.

The mast assembly of such construction as described above will operate as follows. At first, the carriage cylinders 36 extend to have the third chain sheave 62 moved upwards, in response to which the carriage assembly 34 will be lifted up along the inner mast 26 and at last reach the top end of the inner mast 26. Subsequent extension of the lift cylinders 25 will cause the intermediate mast 18 to move upwards along the outer mast 10 together with the first and second chain sheaves 38, 40. At the same time, the inner mast 26 is lifted up by the first and second lift chains 42, 44 along the intermediate mast 18. Thus carriage assembly 34 will be raised up into the highest position. The operation of lowering carriage assembly 34 is essentially the opposite.

While the invention has been shown and described with reference to a preferred embodiment, it should be apparent to one of ordinary skill in the art that many changes and modifications may be made without departing from the spirit and scope of the invention as defined in the claims.

What is claimed is:

1. A mast assembly for forklift trucks comprising:

an outer mast having first and second spaced-apart uprights;

an intermediate mast having first and second uprights elevationally movably fitted to the uprights of the outer mast;

an inner mast having first and second uprights elevationally movably fitted to the uprights of the intermediate mast;

a carriage assembly mounted to the inner mast for elevational sliding movement therealong;

a first hose sheave rotatably attached to a top of the intermediate mast;

a second hose sheave rotatably secured to the intermediate mast at a location below the first hose sheave, said first hose sheave being substantially coplanar with said second hose sheave; and first and second fluid hoses wound respectively around the first and second hose sheaves.

2. The mast assembly of claim 1, wherein said second hose sheave is rotatably secured to the intermediate mast at a location immediately below the first hose sheave and has a diameter smaller than that of the first hose sheave, each of the first and second fluid hoses having a rear end anchored to the outer mast and a front end affixed to the carriage assembly.

3. The mast assembly for forklift trucks as recited in claim 1, wherein the intermediate mast is further provided with a cross member interconnecting the top ends of the uprights thereof, the first hose sheave attached to the cross member by means of a first mounting bracket and the second hose sheave attached to the first upright of the intermediate mast by means of a second mounting bracket.

4. The mast assembly for forklift trucks as recited in claim 3, further comprising a first hose guide bracket mounted to the outer mast for guiding the first fluid hose to the first hose sheave at the rear of the first hose sheave.

5. The mast assembly for forklift truck as recited in claim 3, further comprising a second hose guide bracket mounted to the outer mast for guiding the second fluid hose to the second hose sheave at the rear of the second hose sheave.

* * * * *